United States Patent [19]

Weipert et al.

[11] Patent Number: 4,790,956

[45] Date of Patent: Dec. 13, 1988

[54] ACYLOXYALKANESULFONATE PASTE COMPOSITION AND METHOD FOR PREPARING SAME

[75] Inventors: Eugene A. Weipert; David B. Markobrad, both of Kenosha, Wis.

[73] Assignee: Mazer Chemicals, Inc., Gurnee, Ill.

[21] Appl. No.: 67,037

[22] Filed: Jun. 29, 1987

[51] Int. Cl.[4] ..... C11D 1/12; C11D 17/00

[52] U.S. Cl. ..... 252/538; 252/557; 252/DIG. 14

[58] Field of Search ..... 252/538, 557, DIG. 14

[56] References Cited

U.S. PATENT DOCUMENTS

| | | | |
|---|---|---|---|
| 477,375 | 10/1984 | Grollier | 252/542 |
| 2,894,912 | 7/1959 | Geitz | 252/121 |
| 3,766,097 | 10/1973 | Rosmarin | 252/552 |
| 4,231,904 | 11/1980 | Machin | 252/557 |
| 4,540,507 | 9/1985 | Grollier | 252/174.23 |
| 4,612,136 | 9/1986 | Novakovic | 252/134 |
| 4,663,070 | 5/1987 | Dobrovolny et al. | 252/121 |
| 4,696,767 | 9/1987 | Novakovic et al. | 252/557 |

OTHER PUBLICATIONS

"Fenopon", GAF, Great Britain.

*Primary Examiner*—Prince E. Willis
*Attorney, Agent, or Firm*—Irwin M. Stein

[57] ABSTRACT

Described are acyloxyalkanesulfonate salt compositions of betwee about 30 and about 80 weight percent of the sulfonate salt, e.g., sodium cocoyl isethionate, between about 2 and about 8 weight percent of a water soluble ethoxylated monohydric alcohol, and the balance water. In a further embodiment, the composition contains small amounts of alkali metal salts of water-soluble inorganic and organic acids.

24 Claims, No Drawings

ACYLOXYALKANESULFONATE PASTE COMPOSITION AND METHOD FOR PREPARING SAME

DESCRIPTION OF THE INVENTION

Acyl isethionates are known ingredients of synthetic detergent bars used for personal washing. These detergent bars are superior to soap in mildness and in hard water detergency. The major acyl isethionate used in such bars is an aliphatic fatty acid ester of alkali metal isethionic acid, e.g., sodium cocoyl isethionate, also known as SCI. SCI is mild and well tolerated by persons sensitive to conventional soaps. It is commonly used in syndet bars to impart mildness and better rinsability, and to improve hard water performance and eliminate deposits, such as the adhesion of calcium and magnesium soaps to tubs, sinks and skin. SCI is also used in shampoos, bubble baths, creams and lotions.

Commonly, SCI is incorporated into detergent or soap bar formulations, by adding it to the formulation in the form of a finely-divided powder. When SCI is handled in such a finely-divided state, some difficulties have been encountered with air-borne SIC dust. Elimination of SCI dust in the vicinity of its use is desirable to reduce loss of a valuable product, to reduce equipment and plant maintenance, and to improve the work environment.

U.S. Pat. No. 4,612,136 describes a process for preparing an aqueous surfactant solution and gel of an acyloxyalkanesulfonate salt. In that process, from about 44 to about 56 percent of the sulfonate salt is combined with from about 2 to about 6 percent of a water-soluble polyol and from about 26 to about 36 percent water. This mixture is heated above the boiling point of water under superatmospheric pressure for a period of time sufficient to form a reversible solid colloidal solution. The colloidal solution may be recovered as a firm white gel or solid which liquifies upon heating, or may be used in its molten state directly in a soap or detergent bar manufacturing process. Among the water-soluble polyols described in the aforesaid patent are ethylene glycol, 1,2-propylene glycol, 1,3-propylene glycol, glycerol, 1,3-butylene glycol, sorbitol, mannitol, glucose, fructose, sucrose, lactose, corn syrup and hydrogenated hydrolyzed corn syrup.

It has now been discovered that acyloxyalkanesulfonate salts, e.g., acyl isethionate salts such as sodium cocoyl isethionate, may be prepared in paste form containing relatively high levels of the sulfonate salt by heating the salt with water and a dispersing amount of an ethoxylated fatty alcohol surfactant at temperatures below the boiling point of water and without using superatmospheric pressures, i.e., at atmospheric (ambient) pressures. Use of such paste form eliminates difficulties arising from use of the finely-divided powder form of the salt.

DETAILED DESCRIPTION OF THE INVENTION

Acyloxyalkanesulfonate salts that may be used to prepare the compositions described herein may be represented by the following graphic formula, $$R—C(O)—O(CH_2)_nSO_3^-M^+ \quad (I)$$

wherein R is an aliphatic radical having from 6 to 22 carbon atoms, n is an integer of from 2 to 4 inclusive and M is an alkali metal cation. Preferably, R has between about 8 and about 20 carbon atoms for reasons of solubility and detergency. The aliphatic radical, R, includes linear and branched aliphatic radicals and further includes mixtures of aliphatic radicals within the described carbon chain length as is found, for example, in the preferred alkali metal cocoyl isethionate. Such aliphatic, e.g., alkyl, radical mixtures can be prepared synthetically (from the corresponding fatty acids) but are conveniently available as the mixed fatty acids derived from coconut oil and palm kernel oil, hyrogenated and unhydrogenated. Lauric, caprylic, caproic, myristic, palmitic, stearic, palmitoleic and oleic acids also can be used, alone or in admixture, or in substitution for a part of the preferred coconut oil fatty acids.

The alkane portion of the acyloxyalkanesulfonate salt is selected from the bivalent radicals ethylene, propylene, trimethylene and tetramethylene, i.e., where n is 2, 3, or 4. Preferably n is the integer 2 and is derived from the sulfonic acid, 2-hydroxyethanesulfonic acid.

M in graphic formula I is an alkali metal cation such as lithium, potassium, sodium and ammonium. As used in the present specification and claims, the term alkali metal cation is intended to mean and include the ammonium cation.

Ethoxylated alkyl monohydric alcohols that may be used to prepare the acyloxyalkanesulfonate compositions described herein, may be represented by the graphic formula, $$R'—(CH_2CH_2O)_mOH \quad (II)$$

wherein R' is an alkyl radical (straight or branched chain) having from about 8 to about 18 carbon atoms and m is a number of from about 4 to about 50. More particularly, R' is an alkyl radical of between about 12 and about 18 carbon atoms and m is a number of from about 9 to about 40, e.g., 15 to 25. The letter "m" in formula II, i.e., the number of ethylene oxide units, designates the average number of moles of ethylene oxide present per mole of ethoxylated alcohol and hence may be less than a whole number. Thus, even though "m" is denoted as a number between 4 and 50, each ethoxylated alcohol product may contain a distribution of units with the "m" value representing the average number of moles of ethylene oxide per mole of sulfonate.

The ethoxylated alkyl alcohol is mono-functional, i.e., a monohydric alcohol, and has a sufficient number of ethoxylate groups to be easily dispersible or soluble in water. For convenience, the ethoxylated alcohol will be referred to as water-soluble. The ethoxylated alkyl alcohol may be used as the sole nonionic dispersant for preparing the compositions described herein. A particularly useful ethoxylated alcohol is a mixture of ethoxylated cetyl alcohol and ethoxylated stearyl alcohol and still more particularly, a mixture of about one-third ethoxylated cetyl alcohol and two-thirds ethoxylated stearyl alcohol.

The ethoxylated alcohols may be prepared by ethoxylation of the corresponding alcohol by methods well known in the art. Many such alcohols are currently commercially available. The alkyl portion (R') of the alcohol may be a single alkyl substituent or mixtures of alkyl substituents within the described range of carbon atoms. In practice, mixtures are generally employed (particularly in the case of the higher molecular weight materials) since the precursor alkanols are difficult to purify to single compounds, and also because mixtures function quite as well as single compounds. Commercially available materials, which are generally reported as single compounds are often mixtures. Thus, as used herein, reference to the size of an aliphatic (R) or alkyl (R') chain is to the average carbon length, unless otherwise specified. The precursor alcohols referred to herein may be prepared synthetically or by hydrogenation of the corresponding fatty materials, e.g., beef tallow.

The acyloxyalkanesulfonate compositions described herein comprise between about 30 and about 80 weight percent, more typically between about 40 and about 65, e.g., from about 50-to about 60, weight percent, of the sulfonate salt and between about 2 and about 8 weight percent, more typically between about 3 and about 7 weight percent, of the ethoxylated alcohol. The balance of the composition, i.e., the amount required to reach 100 weight percent, comprises principally water, small amounts, e.g., up to 5 or 6 weight percent, commonly from 1 to 2 weight percent each, of impurities present, for example, in the starting materials, and small amounts (up to about 3 weight percent) of additives. Thus the amount of water in the composition may vary from about 15 to about 65, more particularly from about 25 to 55, weight percent. The weight percentages used herein to describe the amount of alkane sulfonate salt, ethyoxylated aliphatic alcohol, water, etc. are based on the total weight of the final composition.

Impurities that may be present in the composition include, for example, minor amounts of mono- or di-unsaturated fatty acid derivatives contained in the fatty acids of the hydrogenated fats and oils from which the sulfonate salts are prepared. The amount of such unsaturated derivatives in the sulfonate salt is usually such that the salt has an iodine value of below about 20, more usually between about 2 and about 12. Hence, a small amount of alkali metal hydroxide, such as sodium hydroxide or potassium hydroxide, may be incorporated as an additive into the sulfonate salt to react with unreacted fatty acids present therein. Typically the amount of alkali metal hydroxide incorporated is between 0.1 and about 2 weight percent. Another material that may be present in the composition as an impurity is a small amount, e.g., up to 5 or 6 weight percent, of unreacted alkali metal salt of the hydroxy-substituted alkane sulfonic salt, e.g., sodium isethionate.

The aclyoxyalkanesulfonate composition may, depending on the relative amounts of sulfonate salt, ethoxylated alcohol and water, be non-fluid at processing temperatures of 130°-140° F. (54°-60° C.). It has been found further that the addition of small amounts of water-soluble alkali metal salt of inorganic and organic acids to the composition improves its fluidity to the extent that the compostion becomes pourable and pumpable. Such compositions are those that have a viscosity of less than about 3,500 centipoises (cps) at 60° C., as measured by a Brookfield viscometer.

Inorganic salts that may be used include alkali metal sulfates, chlorides, bromides, nitrates, phosphates and mixtures thereof. As used herein, alkali metal is intended to mean and include the alkali metals, e.g., sodium, potassium and lithium and the ammonium cation. In particular, inorganic salts that will be commonly used are the sulfates and chlorides of sodium and potassium, e.g., sodium chloride and sodium sulfate.

Water-soluble alkali metal salts of organic acids include the aforesaid alkali metal salts of hydroxy-substituted alkane sulfonic acid, e.g., sodium isethionate, and salts of other water-soluble organic acids such as citric acid, acetic acid, propionic acid, etc. Of particular interest are the sodium and potassium salts of such organic acids.

The water-soluble alkali metal salts of inorganic and organic acids are used in amounts that result in the formation of a fluid, e.g., pourable or pumpable, composition at temperatures of 130°-140° F. (54°-60° C.). Typically, from about 0.5 to about 3, e.g., 1 to 2, weight percent (based on the final composition) of such salt may be added—such amounts being soluble in the composition. The final acyloxyalkanesulfonate composition may contain slightly higher amounts of the alkali metal inorganic or organic acid salt due to the presence of incidental amounts of such salts in the acyloxyalkanesulfonate starting material, e.g., sodium isethionate and sodium chloride, as a result of the preparative method used to prepare the sulfonate salt. Thus the composition of the present invention may contain from about 0.5 to perhaps about 10 weight percent combined, basis the total weight of the composition, of the aforedescribed alakli metal salts as impurities and/or additives.

The sulfonate salts described herein are well known in the art and are usually prepared by reaction of the desired fatty acid with an alkali metal salt of a hydroxy-substituted alkane sulfonic acid. The salts preferably include mixtures of acyloxy moieties of acids derived from coconut oil or tallow, e.g., beef tallow. The sulfonic acid reactants are hydroxy-substituted alkanesulfonic acids such as 2-hydroxyethanesulfonic acid, 2-hydroxypropanesulfonic acid, 3-hydroxypropanesulfonic acid, 2-hydroxybutanesulfonic acid and 4-hydroxybutanesulfonic acid. The sulfonate salts may also be prepared by reaction of the acyl halide derived from the desired aliphatic acid (fatty acid). g., cocoyl chloride or palmitoyl chloride, with an alkali metal hydroxy-substituted alkanesulfonate, e.g., sodium 2-hydroxy ethanesulfonate (sodium isethionate), sodium 2-hydroxypropanesulfonate, potassium 3-hydroxypropanesulfonate or lithium 2-hydroxybutanesulfonate.

Additionally, minor amounts of other ingredients typically incorporated into detergent and detergent-/soap bars, shampoos, creams and lotions may also be incorporated in the acyloxyalkanesulfonate composition. Examples of such additives include: $C_{12}$-$C_{18}$ fatty acids such as stearic acid and palmitic acid, $C_{12}$-$C_{18}$ fatty alcohols, such as lauryl alcohol, cetyl alcohol or hydrogenated tallow alcohol, opacifiers such as titanium dioxide, builders such as sodium or tripolyphosphate, dyes and fragrances.

In preparing the compositions described herein, the sulfonate salt may be added to an aqueous solution of the ethoxylated aliphatic alcohol dispersant (surfactant); however, other orders of admixing may be utilized. In conducting the process of forming the sulfonate paste, the ethoxylated alcohol and water typically are heated to above room temperature to dissolve the surfactant and form an aqueous solution. Subsequently, the aqueous surfactant solution is heated to between about 60° C. and 95° C. (at atmospheric pressure) and the sulfonate salt slowly added with agitation until the desired amount of salt has been added. Agitation of the mixture should be moderate to avoid the formation of significant amounts of foam.

Time required to prepare the acyloxy sulfonate paste will vary and depend on the temperatures used, the nature of the nonionic surfactant, and the amount of sulfonate salt utilized. Typically, between about 10 and about 90 minutes will be sufficient to form the desired paste.

The present invention is more particularly described in the following examples which are intended as illustrative only since numerous modifications and variations thereof will be apparent to those skilled in the art.

EXAMPLE 1

A mixture of 180 grams of water, 16 grams of ethoxylated hydrogenated tallow alcohol containing about 20 moles of ethylene oxide, (the nonionic surfactant, MACOL® CSA-20) and 4 grams of potassium hydroxide was prepared in a suitable reaction vessel open to the atmosphere and the mixture heated with stirring to about 90° C. Three hundred grams of sodium cocoyl isethionate were added slowly to the mixture with constant stirring over a period of about 30 minutes to form a mixture containing about 60 percent of the sodium cocoyl isethionate, 36 percent water and 3.2 percent of the ethoxylated alcohol surfactant. The resulting mixture was cooled with stirring to room temperature. The product was a creamy white paste.

EXAMPLE 2

30 grams of the non-ionic surfactant MACOL® CSA-20 described in Example 1 and 180 grams of water were mixed in a suitable reaction vessel open to the atmosphere at 50°-55° C. for about 30 minutes to dissolve the surfactant. 4 grams of potassium hydroxide were added to the solution and heated to between 75° and 90° C. while slowly adding with stirring about 200 grams of sodium cocoyl isethionate powder. An additional 20 grams of water was added to the mixture to reduce the gelatinous character of the product. Upon cooling to 30°-35° C., the product formed was a free-flowing pourable paste having a sodium cocoyl isethionate concentration of about 46 percent, a water concentration of about 46 percent and a surfactant concentration of about 7 percent. At room temperature, i.e., about 21° C., the paste was solid and not free-flowing.

EXAMPLE 3

The procedure of Example 2 was repeated except that the nonionic surfactant MACOL® CSA-15 was utilized. This material is similar to the MACOL® CSA-20 surfactant except that the ethoxylated alcohol contains about 15 ethoxylate units. A creamy paste was obtained at about 30°-35° C. The paste was slightly stiffer than the paste obtained in Example 2.

EXAMPLE 4

A mixture of 15 grams of the non-ionic surfactant MACOL® CSA-20 described in Example 1, 167.5 grams of water, 5 grams of sodium chloride, and 2.5 grams of a 45 percent aqueous solution of potassium hydroxide were mixed in a suitable reaction vessel that was set up to return water vapor to said mixture. This mixture was then heated to 60°-70° C. and 310 grams of sodium cocoyl isethionate were added slowly to the mixture with constant stirring over a period of about 45 minutes. A creamy paste that was pourable at 45° C. was obtained.

EXAMPLE 5

Into a two-liter round bottom flask equipped with a stirrer and electric heating mantle was added 280 grams of water, 8 grams of sodium chloride and 24 grams of the nonionic surfactant MACOL® CSA-20. The mixture was heated and mixed at 52° C. Following melting and dissolution of the surfactant, the temperature of the flask contents was raised slowly to 70° C. while continuing slow mixing. 488 grams of sodium cocoyl isethionate was then added in stages to the flask over a period of one hour. After all of the isethionate salt had been added, the contents of the flask were mixed at 70° C. for one hour during which time the mixture became a completely homogeneous opaque fluid. The viscosity of the fluid was approximately 2,000 centipoises.

Paste combinations described herein may also be prepared by heating the sulfonate salt and aqeuous surfactant solution under pressure at above the atmospheric boiling point of water.

EXAMPLE 6

400 grams of water, 40 grams of MACOL® CSA-20 nonionic surfactant, 240 grams of sodium cocoyl isethionate and 120 grams of stearic acid were heated to 105° C. in a closed reaction vessel for about one-half hour with agitation. The product was discharged at about 60° C. The product was a stiff cream which was fluid at 35°-45° C.

EXAMPLE 7

A beaker containing 324 grams of water and 33 grams of MACOL® CSA-20 nonionic surfactant was warmed to 45°-50° C. while stirring the contents. When an aqueous solution of the surfactant was formed, the beaker contents were cooled and 15 grams of 45 percent aqueous potassium hydroxide added to the beaker. Subsequently, the resulting mixture was charged to a closed reactor and 111 grams of stearic acid and 165 grams of sodium cocoyl isethionate powder added to the reactor. The contents of the reactor were heated to 105° C. and stirred for 20 minutes. A vessel pressure of 20 pounds per square inch gauge was recorded. The contents of the reactor were cooled to 40°-50° C. and discharged from the reactor. The product discharged was a creamy paste.

Although the present invention has been described with reference to specific details of certain embodiments thereof, it is not intended that such detail should be regarded as limitations upon the scope of the invention except as and to the extent that they are included in the accompanying claims.

What is claimed is:

1. A paste composition consisting essentially of (a) between about 30 and about 80 weight percent of an acyloxy alkane sulfonate salt represented by the graphic formula:

$$R—C(O)—O(CH_2)_nSO_3^-M^+$$

where R is an aliphatic radical having from 6 to 22 carbon atoms, n is an integer of from 2 to 4 inclusive and M is an alkali metal cation, (b) between about 2 and about 8 weight percent of water-soluble ethoxylated monohydric alkanol represented by the graphic formula, $$R'—(CH_2CH_2O)_mOH$$

wherein R' is an alkyl radical having from about 8 to about 18 carbon atoms and m is a number of from about 4 to 50, and (c) the balance water.

2. The composition of claim 1 wherein the sulfonate salt is present in amounts of from about 40 to 65 weight percent and the ethoxylated monohydric alkanol is present in amounts of from about 3 to 7 weight percent.

3. The composition of claim 2 wherein R is an aliphatic radical having from 8 to 20 carbon atoms, n is 2, R' is an alkyl radical having from 12 to 18 carbon atoms, and m is a number of from 9 to 40.

4. The composition of claim 3 wherein M is the alkali metal sodium or potassium.

5. The composition of claim 2 wherein the sulfonate salt is sodium cocoyl isethionate.

6. A paste composition consisting essentially of (a) between about 30 and about 80 weight percent sodium cocoyl isethionate, (b) between about 2 and about 8 weight percent of water-soluble ethoxylated monohydric alkanol represented by the graphic formula, $$R'—(CH_2CH_2O)_mOH$$

wherein R' is an alkyl radical having from about 8 to about 18 carbon atoms and m is a number of from 4 to 50 and (c) the balance water.

7. The composition of claim 6 wherein R' is an alkyl radical having from 12 to 18 carbon atoms and m is a number of from 9 to 40.

8. The composition of claim 7 wherein sodium cocoyl isethionate is present in amounts of from about 40 to 65 weight percent and the ethoxylated monohydric alcohol is present in amounts of from about 3 to 7 weight percent.

9. The composition of claim 1 wherein there is also present in the composition added salts selected from the group consisting of (a) water-soluble alkali metal sulfates, chlorides, bromides, nitrates and phosphates, and (b) alkali metal salts of the organic acids: hydroxy-substituted alkane sulfonic acid, citric acid, acetic acid and propionic acid in amounts sufficient to form a composition having a viscosity of less than about 3,500 centipoises.

10. The composition of claim 9 wherein the amount of added salt is from about 0.5 to about 3 weight percent.

11. The composition of claim 10 wherein the added salt is selected from the sulfates and chlorides of sodium and potassium.

12. The composition of claim 6 wherein there is also present in the composition added salts selected from the group consisting of (a) water-soluble alkali metal sulfates, chlorides, bromides, nitrates and phosphates, and (b) alakali metal salts of the organic acids: hydroxy-substituted alkane sulfonic acid, citric acid, acetic acid and propionic acid in amounts sufficient to form a composition having a viscosity of less than about 3,500 centipoises.

13. The composition of claim 8 wherein there is also present in the composition added salts selected from the group consisting of (a) water-soluble alkali metal sulfates, chlorides, bromides, nitrates and phosphates, and (b) alkali metal salts of the organic acids: hydroxy-substituted alkane sulfonic acid, citric acid, acetic acid and propionic acid in amounts sufficient to form a composition having a viscosity of less than about 3,500 centipoises.

14. The compositions of claim 13 wherein the amount of added salt is from about 0.5 to about 3 weight percent.

15. The composition of claim 14 wherein the added salt is selected from the sulfates and chlorides of sodium and potassium.

16. A method which comprises heating an admixture of an acyloxy alkane sulfonate salt represented by the graphic formula:

$$R—C(O)—O(CH_2)_nSO_3^-M^+$$

wherein R is an aliphatic radical having from 6 to 22 carbon atoms, n is an integer of from 2 to 4 inclusive and M is an alkali metal cation, (b) water-soluble ethoxylated monohydric alkanol represented by the graphic formula:

$$R'—(CH_2CH_2O)_mOH$$

wherein R' is an alkyl radical having from about 8 to about 18 carbon atoms and m is a number of from about 4 to 50, and (c) water at temperatures of from about 60° C. to about 95° C. for a time sufficient to prepare a paste of the sulfonate salt, the paste containing between about 30 and about 80 weight percent of the sulfonate salt, between about 2 and about 8 weight percent of the ethoxylated alkanol and the balance water.

17. The method of claim 16 wherein the heating step is performed at atmopsheric pressure.

18. The method of claim 16 wherein the sulfonate salt is sodium cocoyl isethionate.

19. The method of claim 18 wherein the admixture also contains added amounts of salts selected from the group consisting of (a) water-soluble alkali metal sulfates, chlorides, bromides, nitrates and phosphates, and (b) alkali metal salts of the organic acids; hydroxy-substituted alkane sulfonic acid, citric acid, acetic acid and propionic acid in amounts sufficient to form a paste composition having a viscosity of less than about 3,500 centipoises.

20. The method of claim 19 wherein the amount of salt added is from about 0.5 to about 3 weight percent, and the salts are selected from the sulfates and chlorides of sodium and potassium.

21. The method of claim 16 wherein R is an aliphatic radical having from 8 to 20 carbon atoms, R' is an alkyl radical of from 12 to 18 carbon atoms, n is 2, m is a number of from about 15 to 25, and M is sodium, potassium or ammonium.

22. The method of claim 21 wherein the paste contains between about 40 and 65 weight percent of the sulfonate salt, between about 3 and about 7 weight percent of the ethoxylated alcohol and sufficient water to reach 100 weight percent.

23. The method of claim 22 wherein the admixture also contains between about 0.5 and 3 weight percent of added water-soluble salts selected from the group consisting of alkali metal sulfates, alkali metal chlorides and alkali metal salts of the organic acids: hydroxy-substituted alkane sulfonic acid, citric acid and acetic acid, the amount of added salt being sufficient to form a paste composition having a viscosity of less than 3,500 centipoises.

24. The method of claim 23 wherein the alkali metal salts are the salts of sodium or potassium and the hydroxy-substituted alkane sulfonic acid is 2-hydroxyethanesulfonic acid.

* * * * *